United States Patent [19]

Spellman

[11] 3,991,736

[45] Nov. 16, 1976

[54] RATCHET DRIVING INTERNAL COMBUSTION ENGINE

[75] Inventor: Robert C. Spellman, Alhambra, Calif.

[73] Assignee: Raymond Lee Organization, Inc., New York, N.Y.

[22] Filed: Nov. 17, 1975

[21] Appl. No.: 632,486

[52] U.S. Cl. ..... 123/197 R; 123/197 C

[51] Int. Cl.[2] ..... F02B 75/32

[58] Field of Search ..... 123/197 R, 197 C, 56 R, 123/56 AA, 56 AB, 56 AC, 56 BA, 56 BB, 56 BC

[56] References Cited

UNITED STATES PATENTS

| | | | |
|---|---|---|---|
| 533,290 | 1/1895 | Gray | 123/197 C |
| 1,347,055 | 7/1920 | Peterson | 123/197 C |
| 1,699,803 | 1/1929 | Myers | 123/197 C |
| 3,200,800 | 8/1965 | Du Bois | 123/197 R |
| 3,520,285 | 7/1970 | Klauder | 123/197 R |

*Primary Examiner*—Charles J. Myhre
*Assistant Examiner*—Daniel J. O'Connor
*Attorney, Agent, or Firm*—Stephen Wyden

[57] ABSTRACT

Two reciprocating pistons in opposite cylinders connected by a shaft that fears ratchet nuts that engage and drive a flywheel which may drive another device.

1 Claim, 3 Drawing Figures

RATCHET DRIVING INTERNAL COMBUSTION ENGINE

I have invented a new and novel ratchet driving internal combustion engine. My engine has two opposite cylinders and a pair of pistons on the same shaft. By preventing the pistons from rotating as they reciprocate, ratchet grooves in the shaft cause a flywheel to rotate and the rotating flywheel engages the transmission to deliver the torque to operate other devices.

My invention can be understood in view of the accompanying figures.

Figure 1:
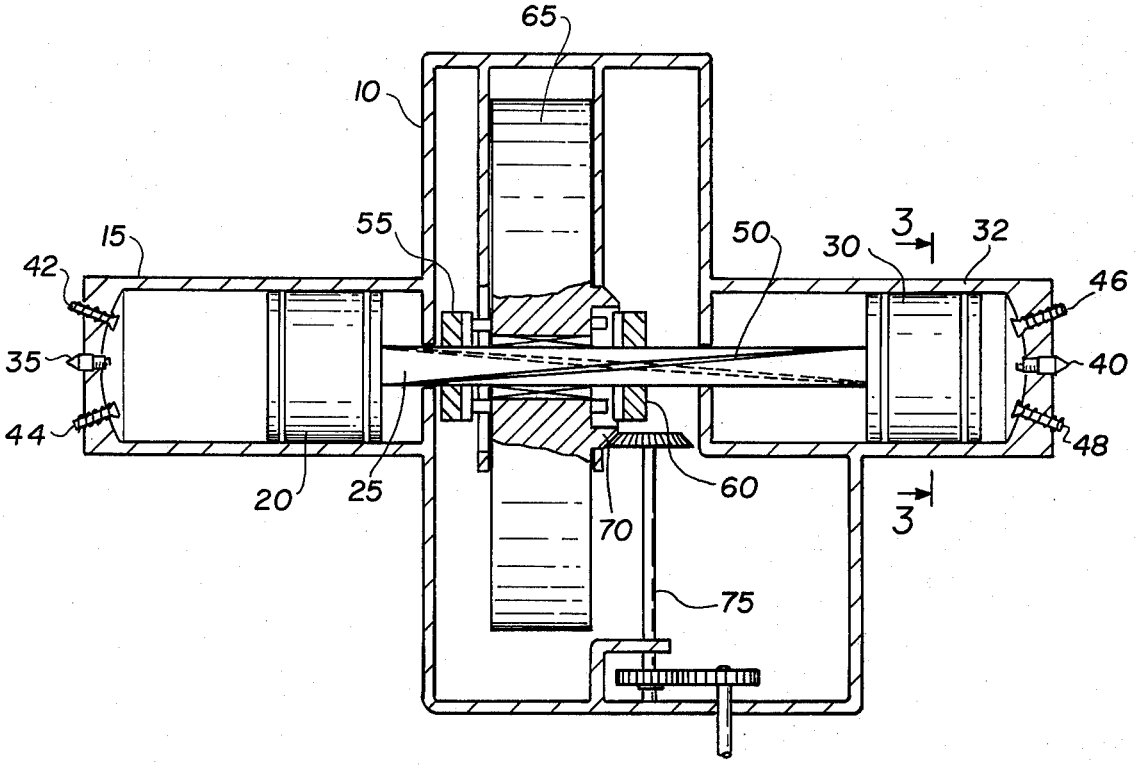
FIG. 1 is a sectional view of the engine.

In FIG. 1, in an engine block 10 is formed a cylinder 15 in which is mounted a piston 20 connected by a shaft 25 to a second pistion 30 in a second cylinder 32. Spark plugs, 35 and 40, and valves, 42, 44, 46, and 48 permit the burning of gasoline and similar fuels. A key may 50 formed in the shaft 25 engages a stud in a ratchet nut 55 and 60, next to each piston, 20 and 30. The reciprocating of the pistons drives the ratchet nut 55 into engagement with a flywheel 65 causing the flywheel 65 to rotate. The reciprocating stroke drives the other ratchet nut 60 into engagement with the flywheel 65 causing the flywheel 65 to continue to rotate in the same direction. The flywheel 65 forms a gear 70 that drives a set of gears 75 to deliver a torque to drive some device.

Figure 2:
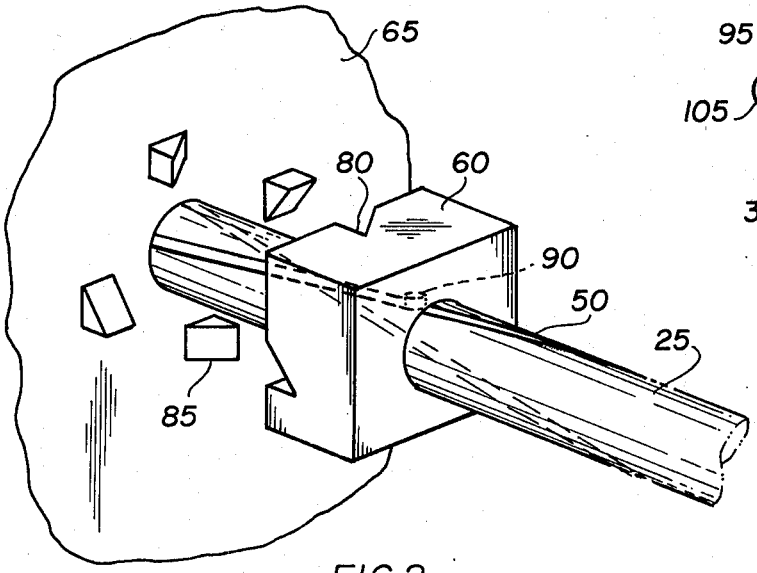
FIG. 2 is a view of one of the ratchet nuts engaging the lugs of the flywheel.

In FIG. 2, the ratchet nut 60 forms a set of recesses 80 that engage a set of lugs 85 attached to the flywheel 65 to drive the flywheel 65 when the stud 90 riding in the keyway 50 of the shaft 25 causes the ratchet nut 60 to rotate.

Figure 3:
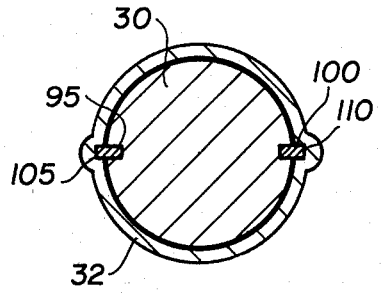
FIG. 3 is a section of FIG. 1 in the plane 3—3, showing the bearings that keep the pistons reciprocating and not rotating.

In FIG. 3, a pair of bearings, 95 and 100, mounted in the piston 30 ride in a pair of lineor keyways 105 and 110 in the walls of the cylinder 32 in order to keep the pistons reciprocating and prevent them from rotating.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A ratchet driving internal combustion engine, comprising:

an engine block forming a first cylinder and a second cylinder, a first piston mounted in the first cylinder, a shaft connected to the first piston, a second piston connected to the shaft and mounted in the second cylinder, a spark plug mounted in the first cylinder, a spark plug mounted in the second cylinder, valves mounted in the first cylinder, valves mounted in the second cylinder, whereby the pistons may be moved by internal combustion, a wall of the first cylinder forming a linear keyway, a bearing mounted in the first piston and engaging the linear keyway, whereby the first piston may reciprocate in the first cylinder but is prevented from rotating, a wall of the second cylinder forming a second linear keyway, another bearing mounted in the second piston and engaging the second linear keyway, whereby the second piston may reciprocate in the second cylinder but is prevented from rotating, the shaft forming a keyway (50)

a first stud engaging the keyway (50), a first ratchet nut mounted on the shaft and engaging the first stud near the first cylinder, a second stud engaging the keyway (50), a second ratchet nut mounted on the shaft and engaging the second stud near the second cylinder, a flywheel rotatably mounted on the shaft, a first lug attached to the flywheel on a side of the flywheel near the first ratchet nut, the first ratchet nut forming a recess which releasably engages the first lug, whereby the first piston may drive the first ratchet nut to drive the flywheel to rotate, a second lug attached to the flywheel on a side of the flywheel near the second ratchet nut, the second ratchet nut forming a recess which releasably engages the second lug, whereby the second piston may drive the second ratchet nut to drive the flywheel to rotate, the flywheel forming a gear, and another gear engagably connected to the gear of the flywheel, whereby the rotation of the flywheel may drive a device.

* * * * *